US006989049B2

(12) United States Patent
Belson et al.

(10) Patent No.: US 6,989,049 B2
(45) Date of Patent: Jan. 24, 2006

(54) AIRBORNE CONDUCTIVE CONTAMINANT HANDLER

(75) Inventors: Stev Arthur Belson, Plano, TX (US); Shaun Harris, McKinney, TX (US); Christian L Belady, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 126 days.

(21) Appl. No.: 10/655,384

(22) Filed: Sep. 4, 2003

(65) Prior Publication Data

US 2005/0051027 A1 Mar. 10, 2005

(51) Int. Cl.
*B03C 3/68* (2006.01)

(52) U.S. Cl. ..... 96/2; 55/385.6; 95/3; 95/79; 96/19; 96/26; 96/77; 96/80; 96/96; 422/22; 422/121

(58) Field of Classification Search ..... 96/2, 96/19, 26, 70, 75–77, 80, 96, 97; 55/385.6; 95/3, 79, 133; 422/22, 121; 324/464; 361/225–235; 15/1.51; 134/1.3
See application file for complete search history.

(56) References Cited

U.S. PATENT DOCUMENTS

| | | | | | |
|---|---|---|---|---|---|
| 4,094,653 | A | * | 6/1978 | Masuda | 96/77 |
| 4,265,641 | A | * | 5/1981 | Natarajan | 95/79 |
| 4,318,152 | A | * | 3/1982 | Weber | 96/24 |
| 4,643,745 | A | * | 2/1987 | Sakakibara et al. | 96/76 |
| 4,861,356 | A | * | 8/1989 | Penney | 96/77 |
| 5,061,296 | A | * | 10/1991 | Sengpiel et al. | 95/7 |
| 5,695,549 | A | * | 12/1997 | Feldman et al. | 96/55 |
| 5,707,428 | A | * | 1/1998 | Feldman et al. | 96/54 |
| 5,711,788 | A | * | 1/1998 | Kim et al. | 96/3 |
| 5,766,319 | A | * | 6/1998 | Kogelschatz | 96/75 |
| 5,969,942 | A | * | 10/1999 | Heckner et al. | 361/695 |
| 6,033,565 | A | * | 3/2000 | Van Heesch et al. | 210/243 |
| 6,043,639 | A | * | 3/2000 | Arrowsmith et al. | 324/71.4 |
| 6,077,335 | A | * | 6/2000 | Schneider et al. | 96/135 |
| 6,086,657 | A | * | 7/2000 | Freije | 95/2 |
| 6,251,171 | B1 | * | 6/2001 | Marra et al. | 96/69 |
| 6,379,427 | B1 | * | 4/2002 | Siess | 95/57 |
| 6,496,997 | B1 | * | 12/2002 | Murari et al. | 15/1.51 |
| 6,610,123 | B2 | * | 8/2003 | Wu et al. | 95/69 |
| 6,623,544 | B1 | * | 9/2003 | Kaura | 95/3 |
| 6,664,492 | B1 | * | 12/2003 | Babb et al. | 209/127.1 |
| 6,785,114 | B2 | * | 8/2004 | Gorczyca et al. | 361/231 |
| 6,835,233 | B2 | * | 12/2004 | Fang | 95/273 |
| 6,859,024 | B2 | * | 2/2005 | Molnar et al. | 324/71.4 |
| 2002/0162405 | A1 | * | 11/2002 | Carbone et al. | 73/864.71 |
| 2002/0195956 | A1 | * | 12/2002 | Molnar et al. | 315/169.2 |

FOREIGN PATENT DOCUMENTS

| | | | | |
|---|---|---|---|---|
| JP | 52-33173 | * | 3/1977 | 96/77 |

* cited by examiner

*Primary Examiner*—Richard L. Chiesa

(57) ABSTRACT

An example airborne conductive contaminant handling system is described. The airborne conductive contaminant handling system may include a handling circuit that is configured to selectively pass an electric current through a conductive contaminant. The airborne conductive contaminant handling system may also include an attracting circuit that is configured to attract an airborne conductive contaminant towards the handling circuit, where it can be subjected to the electric current.

39 Claims, 11 Drawing Sheets

AIRBORNE CONDUCTIVE CONTAMINANT HANDLER

BACKGROUND

Zinc (Zn) is an element that can help prevent the oxidation of ferrous materials. Thus, steel may be coated and/or treated with zinc. Some treated materials may produce metal strands known as zinc whiskers. A zinc whisker is a small metal strand that may form on the surface of the treating material. By way of illustration, when ferrous metals like steel are plated with zinc to prevent surface corrosion, molecular level stresses in the plating metal (e.g., zinc) may occur. The crystalline structure within the plating metal may attempt to relieve the internal molecular level stress by enlarging the structure through crystal growth, where the crystals grow out from the plating metal. The crystals that are pushed out of the plating metal can be referred to as zinc whiskers.

Zinc whiskers may grow from the plating metal without external stimuli and have been observed to grow in a vacuum. Zinc whiskers may also be formed in response to the application of an external compressive stress on the plating metal. Similarly, metal "whiskers" can grow from other metals like tin, cadmium, and the like. Zinc whiskers may grow at rates of about 5 microns per year to about 250 microns per year and may be, for example, a few microns in width and several hundred to several thousand microns in length. It is to be appreciated that zinc whiskers and the like may grow at various rates and have various lengths and widths.

Zinc whiskers may originate, for example, from zinc treated (e.g., electroplated) products (e.g., floor tiles) commonly used in computer rooms. For example, a floor tile with a wooden core may have a flat sheet of steel on its bottom that has been treated (e.g., electroplated) with zinc. Over time, zinc whiskers may form on the zinc electroplating on the underside of the floor tile. If the floor tiles are moved during, for example, a computer upgrade, a computer room cleaning, rewiring, and other similar activities, the zinc whiskers may detach from the floor panel and begin circulating in the computer room air supply. The zinc whiskers therefore can become one type of airborne conductive contaminant to which computer circuits, power supplies and the like may be exposed. While floor tiles are described as one source of zinc whiskers, it is to be appreciated that airborne conductive contaminants like zinc whiskers can enter the air supply of a computer room by other manners. Similarly, while a computer room is described, computers, electronics and electrical equipment located in other environments (e.g., office, aircraft, spacecraft, factory) may also be exposed to airborne conductive contaminants like zinc whiskers.

Zinc is an electrically conductive material. Thus, in one example, a zinc whisker may act like a low capacity fuse with a DC resistance of about 10 to 40 ohms depending on the whisker geometry. In another example, a zinc whisker may have a DC fusing current of around 10 to 30 mA. While example zinc whiskers of various sizes, resistances, and fusing currents are described, it is to be appreciated that other airborne conductive contaminants with other sizes, resistances, and fusing currents may be present in the air available to a computer or other electronic component.

BRIEF DESCRIPTION OF THE DRAWINGS

The accompanying drawings, which are incorporated in and constitute a part of the specification, illustrate various example systems that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
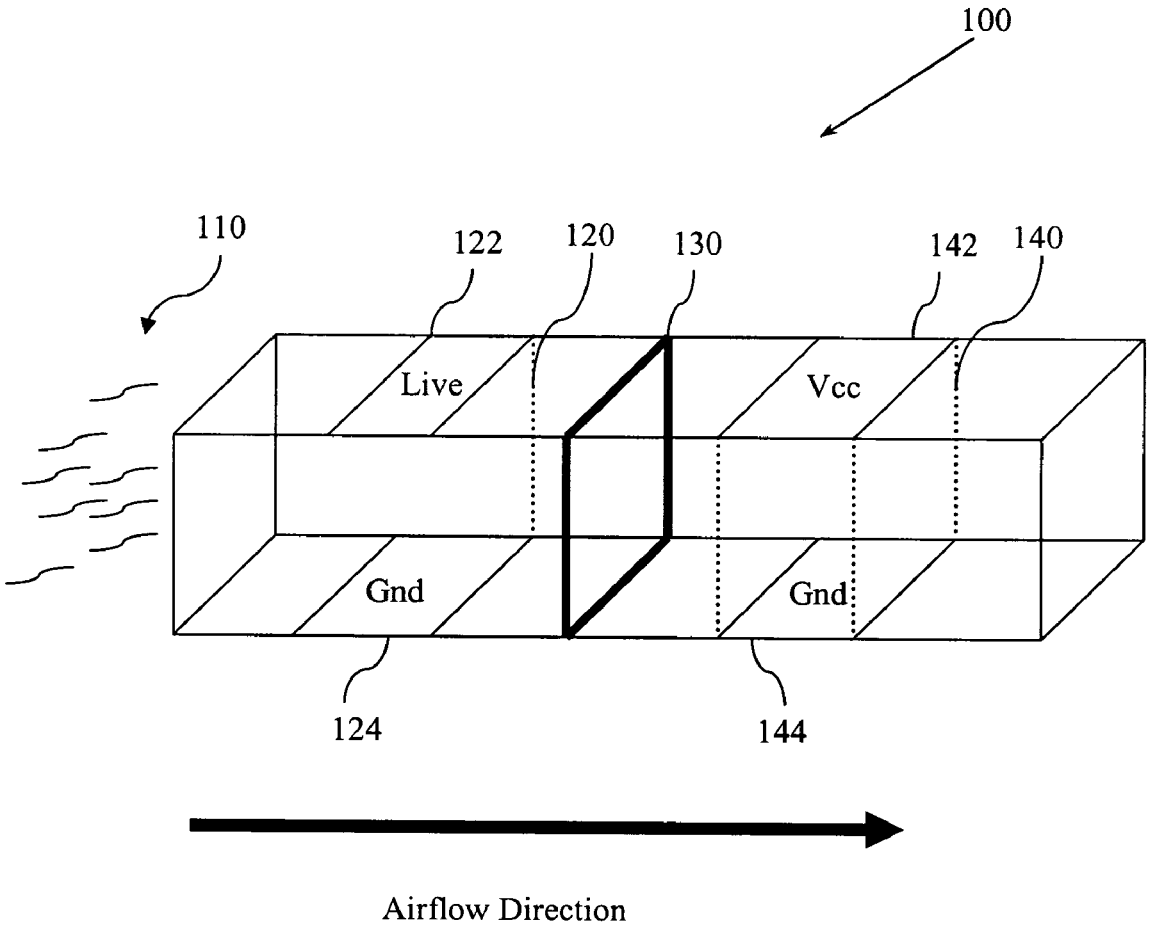
FIG. 1 illustrates an example airborne conductive contaminant handler.

A high voltage area like a power supply in a server computer may be negatively impacted by airborne conductive contaminants like zinc whiskers. Thus, in one example, an airborne conductive contaminant handler may be configured to destroy (e.g., vaporize) and/or capture airborne conductive contaminants like zinc whiskers. A zinc whisker, or other metal filament-like body may, for example, become an airborne conductive contaminant and cause a short circuit. For example, a zinc whisker may come to rest across a voltage potential in the power supply. Since the zinc whisker is electrically conductive it may cause a short circuit or voltage variance across the voltage potential. Thus, in one example, an airborne conductive contaminant handler may include a first high voltage circuit that attracts airborne conductive contaminants towards a second circuit. The second circuit may be configured to facilitate protecting a computer or electronic system or components by capturing and/or destroying the airborne conductive contaminants. The zinc whiskers may come in contact with the second handling circuit where they are destroyed by, for example, an electric current. Additionally, and/or alternatively, the circuit(s) may be configured to detect and/or contain zinc whiskers.

More generally, example systems and methods described herein relate to disrupting the flow of and/or destroying airborne conductive contaminants like zinc whiskers to mitigate the effects such conducting bodies may have on electrical, computer, and/or electronic components. The conductive contaminants may take the form of filament like metal strands that can be carried onto a circuit by air. The undesired effects caused by these airborne conductive contaminants can include, but are not limited to, voltage variances and short circuits on power supplies, integrated circuit (IC) cards, computer circuits, and other electronic components. The effects can arise because the zinc whiskers may conduct a signal and/or current in an undesired path. The effects may be mitigated by, for example, destroying the zinc whisker before it can come in contact with the electrical, computer, and/or electronic components. Additionally, and/or alternatively, the airborne conductive contaminant handling system can alert users, processes, and other systems that airborne conductive contaminants like zinc whiskers have been detected and/or handled.

One way to combat the effects of airborne conductive contaminants like zinc whiskers is to design a system so that the distance between a high voltage area and a low voltage area is greater than the length of a zinc whisker. Thus, if a zinc whisker enters a system and lands on or near the high voltage area, it will not be long enough to reach the low voltage area and short circuits may be avoided. However, with increasing circuit densities and component densities inside computer, electric and/or electronic components, and the resulting decreasing distances between high and low voltage areas, it may be difficult to maintain adequate distances between voltage areas. Furthermore, zinc whiskers and other airborne conductive contaminants may have varying lengths, and/or may grow over time after entering a system or component (e.g., power supply) which complicates designing a system based on contaminant length.

Another approach to combat the effects of airborne conductive contaminants like zinc whiskers is to attempt to use particle blocking filters to filter the air with which computer, electric and/or electronic components will come in contact. However, since zinc whiskers can be small (e.g., width=2 microns, length=50 microns) particle blocking filters may not capture and filter out zinc whiskers. If a filter with a small pore size (e.g., high efficiency particle arresting (HEPA) filter) is employed, then air flow in a computer, electric and/or electronic system may be negatively impacted, causing additional undesired effects (e.g., high pressure drop, overheating, larger fan requirements). These undesired effects can lead to a decrease in system reliability and a higher failure rate.

Another approach to dealing with airborne conductive contaminants like zinc whiskers is to attempt to break the contaminants into smaller pieces using a fan(s) involved in supplying air to an electronic, electric, and/or computer component and/or system. For example, many computers include a fan that blows air over electronic components to cool them. However, the fan(s) may not break the whiskers into small enough pieces, if they break them apart at all. Furthermore, the fan(s) may be placed downstream of the components they are cooling so that the fans draw air over the component rather than push air over the component. In this configuration, the zinc whiskers would not encounter the fan(s) until after the zinc whiskers passed over the component.

Thus, in one example, a high voltage attracting circuit in an airborne conductive contaminant handler is designed to attract zinc whiskers towards a handling circuit before they can reach the entity being protected. For example, the attracting circuit voltage may be much higher (e.g., 50% to 200%) than the highest DC voltage internal to a power supply being protected. While 50 percent to 200 percent is described as one example of a much higher voltage, it is to be appreciated that other ranges can be employed. An example handling circuit may include, for example, two or more exposed wires with different voltages. The exposed wires can be thought of as contacts on a switch that an airborne conductive contaminant can close by spanning the contacts. Another example handling circuit may include, for example, two or more contacts with different voltages on a printed circuit board. In an example handling circuit, a ground contact is located close enough to a source contact so that a zinc whisker can span the distance between the two contacts. When a zinc whisker touches both the source and ground contacts, current can flow through the conductive contaminant (which is now no longer airborne, having come to rest on the contacts), causing it to be destroyed (e.g., melted, vaporized) and/or rendered harmless (e.g., broken into smaller parts). It is to be appreciated that the attracting circuit and the handling circuit may be part of one circuit.

The following includes definitions of selected terms employed herein. The definitions include various examples and/or forms of components that fall within the scope of a term and that may be used for implementation. The examples are not intended to be limiting. Both singular and plural forms of terms may be within the definitions.

The terms "high voltage area" and "low voltage area", and the terms "high voltage" and "low voltage" are relative terms as employed herein. For example, a computer circuit board may have a "high voltage" of +5 volts and a "low voltage" of −5 volts, an electronic circuit may have a "high voltage" of 15 volts and a "low voltage" of 5 volts, and a computer power supply may have a "high voltage" of 110 volts and a low voltage of 0 volts. Thus the terms "high voltage" and "low voltage" should not be limited to specific ranges of voltages but rather should be construed as relative terms that indicate that a voltage differential exists between the "high voltage area" and the "low voltage area". Furthermore "high voltage" and "low voltage" are intended to encompass both direct current circuits with a positive voltage side and a negative voltage side and alternating current circuits that have a live (feed, hot) side and a neutral (return, ground) side.

"Computer-readable medium", as used herein, refers to a medium that participates in directly or indirectly providing signals, instructions and/or data. A computer-readable medium may take forms, including, but not limited to, non-volatile media, volatile media, and transmission media. Non-volatile media may include, for example, optical or magnetic disks and so on. Volatile media may include, for example, optical or magnetic disks, dynamic memory and the like. Transmission media may include coaxial cables, copper wire, fiber optic cables, and the like. Transmission media can also take the form of electromagnetic radiation, like those generated during radio-wave and infra-red data communications, or take the form of one or more groups of signals. Common forms of a computer-readable medium include, but are not limited to, an application specific integrated circuit (ASIC), a compact disc (CD), a digital versatile disk (DVD), a random access memory (RAM), a read only memory (ROM), a programmable read only memory (PROM), an electronically erasable programmable read only memory (EEPROM), a disk, a carrier wave, a memory stick, a floppy disk, a flexible disk, a hard disk, a magnetic tape, other magnetic medium, a CD-ROM, other optical medium, punch cards, paper tape, other physical medium with patterns of holes, an EPROM, a FLASH-EPROM, or other memory chip or card, and other media from which a computer, a processor or other electronic device can read. Signals used to propagate instructions or other software over a network, like the Internet, can be considered a "computer-readable medium."

"Logic", as used herein, includes but is not limited to hardware, firmware, software and/or combinations of each to perform a function(s) or an action(s), and/or to cause a function or action from another component. For example, based on a desired application or needs, logic may include a software controlled microprocessor, discrete logic like an ASIC, a programmed/programmable logic device, a memory device containing instructions, or the like. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Signal", as used herein, includes but is not limited to one or more electrical or optical signals, analog or digital, one or more computer or processor instructions, messages, a bit or bit stream, or other means that can be received, transmitted and/or detected.

"Software", as used herein, includes but is not limited to, one or more computer or processor instructions that can be read, interpreted, compiled, and/or executed and that cause a computer, processor, or other electronic device to perform functions, actions and/or behave in a desired manner. The instructions may be embodied in various forms like routines, algorithms, modules, methods, threads, and/or programs including separate applications or code from dynamically linked libraries. Software may also be implemented in a variety of executable and/or loadable forms including, but not limited to, a stand-alone program, a function call (local and/or remote), a servelet, an applet, instructions stored in a memory, part of an operating system or other types of executable instructions. It will be appreciated by one of ordinary skill in the art that the form of software may depend on, for example, requirements of a desired application, the environment in which it runs, and/or the desires of a designer/programmer or the like. It will also be appreciated that computer-readable and/or executable instructions can be located in one logic and/or distributed between two or more communicating, co-operating, and/or parallel processing logics and thus can be loaded and/or executed in serial, parallel, massively parallel and other manners.

Suitable software for implementing the various components of the example systems and methods described herein include programming languages and tools like Java, Pascal, C#, C++, C, CGI, Perl, SQL, APIs, SDKs, assembly, machine, firmware, microcode, and/or other languages and tools. Software, whether an entire system or a component of a system, may be embodied as an article of manufacture and maintained as part of a computer-readable medium as defined previously. Another form of the software may include signals that transmit program code of the software to a recipient over a network or other communication medium.

FIG. 1 illustrates an example airborne conductive contaminant handler 100. Airborne conductive contaminants 110 may be present in the air to which electric, electronic, and/or computer components and/or circuits may be exposed. The handler 100 may include a handling circuit 120 configured to selectively pass an electric current through the conductive contaminant(s) 110. The handling circuit 120 may include, for example, a first contact 122 that is associated with a relatively higher voltage (e.g., live wire) and a second contact 124 that is associated with a relatively lower voltage (e.g., ground). To draw the airborne conductive contaminant(s) 110 towards the contacts 122 and 124, the handler 100 may include an attracting circuit 130 configured to attract the airborne conductive contaminant(s) 110. The attracting circuit 130 may attract the contaminant(s) 110 electro-magnetically, for example. Thus, the airborne conductive contaminant(s) 110 may come in contact with both the contacts 122 and 124, which may, for example, close the handling circuit 120, allowing an electric current to flow through the conductive contaminant(s) 110. Thus, the airborne conductive contaminant(s) 110 may be destroyed before reaching a component 140 that may include a relatively higher voltage area (e.g., Vcc component 142) and a relatively lower voltage area (e.g., ground 144). In one example, the voltage in the attracting circuit 130 may be higher than the highest voltage in the electric, electronic, and/or computer components and/or circuits to be protected. By way of illustration, in a first attracting circuit 130, the voltage may be twice as high as the highest voltage in the component being protected. By way of further illustration, in a second attracting circuit 130, the voltage may be five times as high as the highest voltage in the component being protected. While two times and five times are provided as examples of the ratio of voltage between the attracting circuit 130 and a component being protected, it is to be appreciated that other ratios can be employed.

The system 100 may protect components including, but not limited to, a power supply, an integrated circuit, a computer circuit, an electric circuit, and the like. In one example, the airborne conductive contaminant 110 may be a zinc whisker. Thus, the electric current that can flow between the first contact 122 and the second contact 124 via the zinc whisker is set to a level sufficient to substantially destroy a zinc whisker. The zinc whisker may be, for example, vaporized, melted, broken into small segments, and so on. In one example, the current may be sufficient to substantially destroy a zinc whisker having a direct current resistance of about five ohms to about fifty ohms. In another example, the current may be sufficient to substantially destroy a zinc whisker with a direct current fusing current of about 5 mA to about 40 mA. While five to fifty ohms and 5 mA to 40 mA are provided as examples, it is to be appreciated that zinc whiskers with other properties may be handled.

Figure 2:
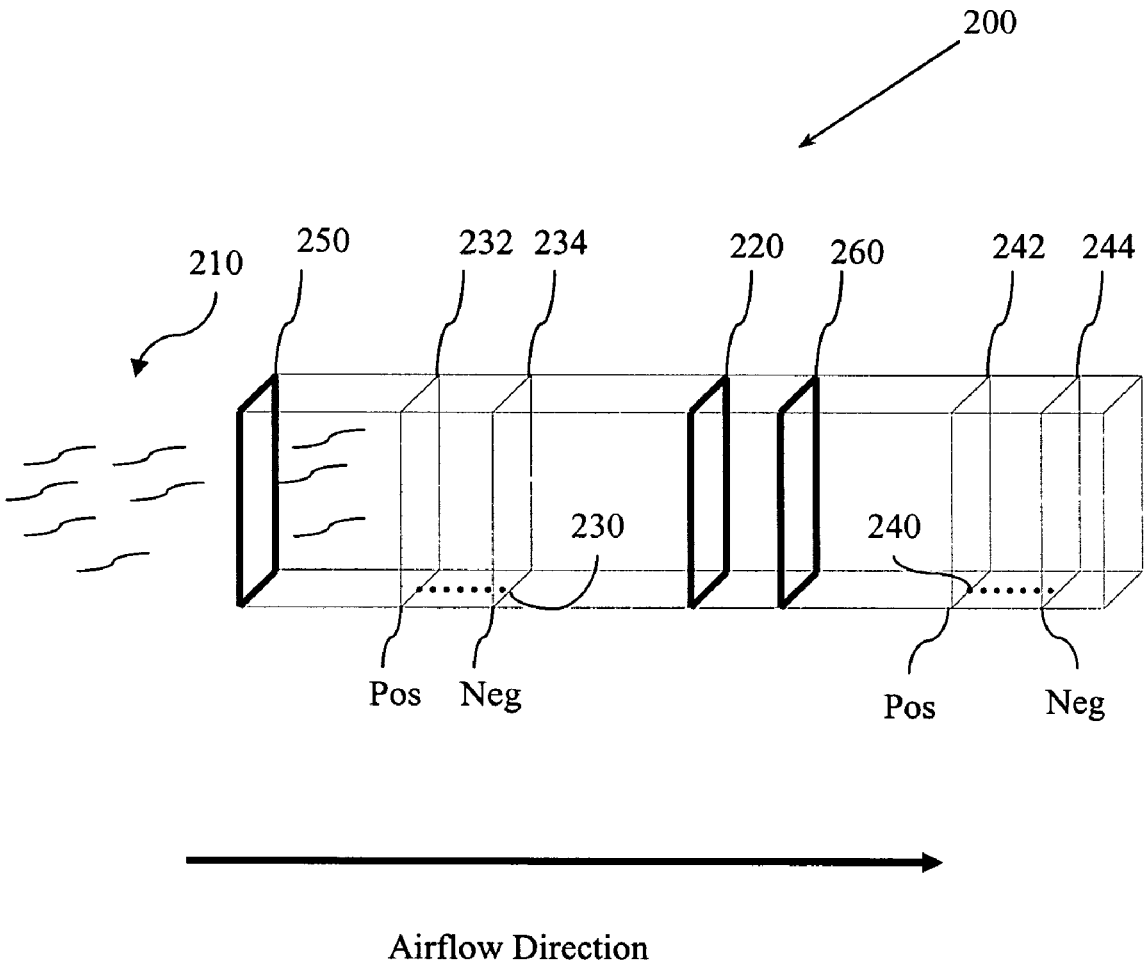
FIG. 2 illustrates another example airborne conductive contaminant handler.

FIG. 2 illustrates an example airborne conductive contaminant handler 200. The handler 200 may be exposed to air that includes one or more airborne conductive contaminants 210 like zinc whiskers. Thus, the handler 200 may include an attracting circuit 220 and a handling circuit 230. While the attracting circuit 220 and the handling circuit 230 are illustrated separately, it is to be appreciated that the attracting circuit 220 and the handling circuit 230 could be combined into one circuit.

The handling circuit 230 may include two contacts associated with two different voltages. For example, a first contact 232 may be a positive terminal while a second contact 234 may be a negative terminal. While two contacts 232 and 234 are illustrated, it is to be appreciated that the handling circuit 230 may include a greater number of contacts. The attracting circuit 220 can attract the airborne conductive contaminants 210 towards the contacts 232 and 234, for example, electro-magnetically. The handling circuit 230 can then destroy the airborne conductive contaminants 210 thereby protecting a downstream circuit like circuit 240 that may include a first contact area with a first voltage level (e.g., +terminal 242) and a second contact area with a second voltage level (e.g., −terminal 244).

The system 200 may also include an apparatus 250 that facilitates receiving air from an external environment that may contain airborne conductive contaminants 210. For example, a fan, an airjet, an impeller, and other similar apparatus may be included in system 200 to facilitate directing the air towards the attracting circuit 220 and thus towards the handling circuit 230. While the apparatus 250 is illustrated upstream from both the handling circuit 230 and the attracting circuit 220, it is to be appreciated that the apparatus 250 could be located in different positions.

The system 200 may also include an apparatus 260 that facilitates selectively directing air from which an airborne conductive contaminant has been processed by the handling circuit 230 relative to (e.g., towards, away from) a component (e.g., circuit 240) to be protected from airborne conductive contaminants 210. In one example, when the handling circuit 230 passes an electric current through a conductive contaminant 210, the apparatus 260 may be configured to momentarily reverse the airflow through the handler 200 to facilitate exhausting residue from the handled conductive contaminant 210. In another example, when the handling circuit 230 is in a refractory period (e.g., recharging), the apparatus 260 may be configured to hinder airflow from the external environment to the component(s) to be protected.

Thus, one example handler 200 can attract a zinc whisker towards a desired location (e.g., handling circuit), detect that a zinc whisker has been attracted to the desired location by, for example, having a first detecting current flow through closed circuit, and substantially destroy the zinc whisker in the desired location by, for example, having a second destroying current flow through the closed circuit.

Figure 3:
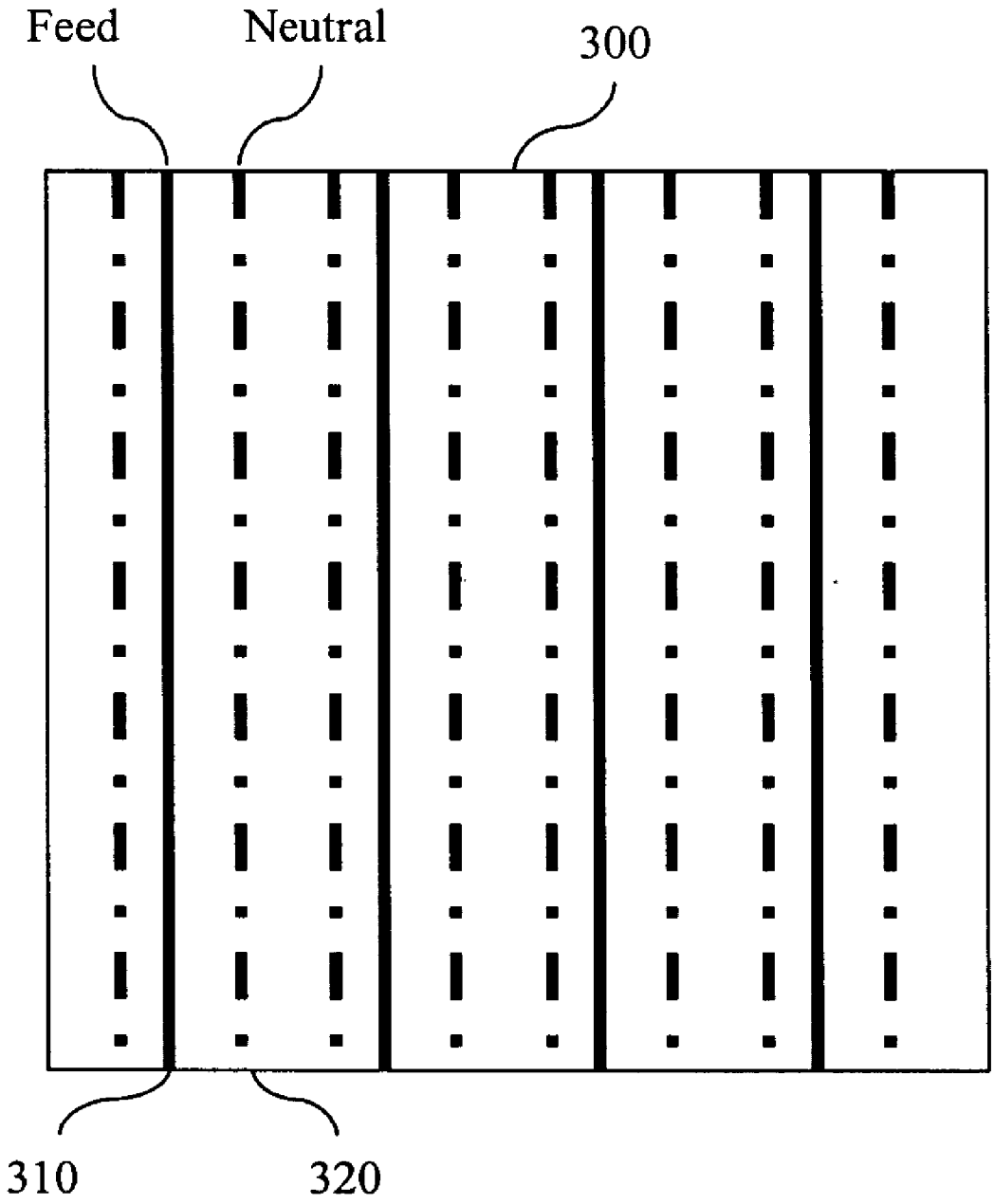
FIG. 3 illustrates an example arrangement of high voltage areas and low voltage areas associated with an airborne conductive contaminant handling circuit.

FIG. 3 illustrates an example arrangement of high voltage areas and low voltage areas associated with an airborne conductive contaminant handling circuit 300. The solid lines 310 represent a relatively high voltage area and the dotted lines 320 represent a relatively low voltage area. One example handling circuit 300 may include one set of contacts (e.g., one high voltage line 310 and one low voltage line 320) while another example handling circuit 300 may include two or more sets of contacts. There may be an equal and/or unequal number of high voltage contacts and low voltage contacts. In one example, contacts are located not more than 500 microns apart. In another example, contacts are located not more than 20 microns apart. While 500 and 20 micron separations are described, it is to be appreciated that various spacings between contacts can be employed. In one example, the contacts 310 and 320 may be exposed wires. In another example, the contacts 310 and 320 may be printed runs on a computer card. While exposed wires and printed runs are described, it is to be appreciated that other types of contacts may be employed. Furthermore, while the contacts 310 and 320 are illustrated as parallel lines in circuit 300, it is to be appreciated that various other arrangements like radial, wavy, random, patterned and so on may be employed. Additionally, in one example, some pairs of high voltage areas 310 and low voltage areas 320 may be the feed and return in an alternating current circuit while some pairs of high voltage areas 310 and low voltage areas 320 may be positive and negative contacts in a direct current circuit.

Figure 4:
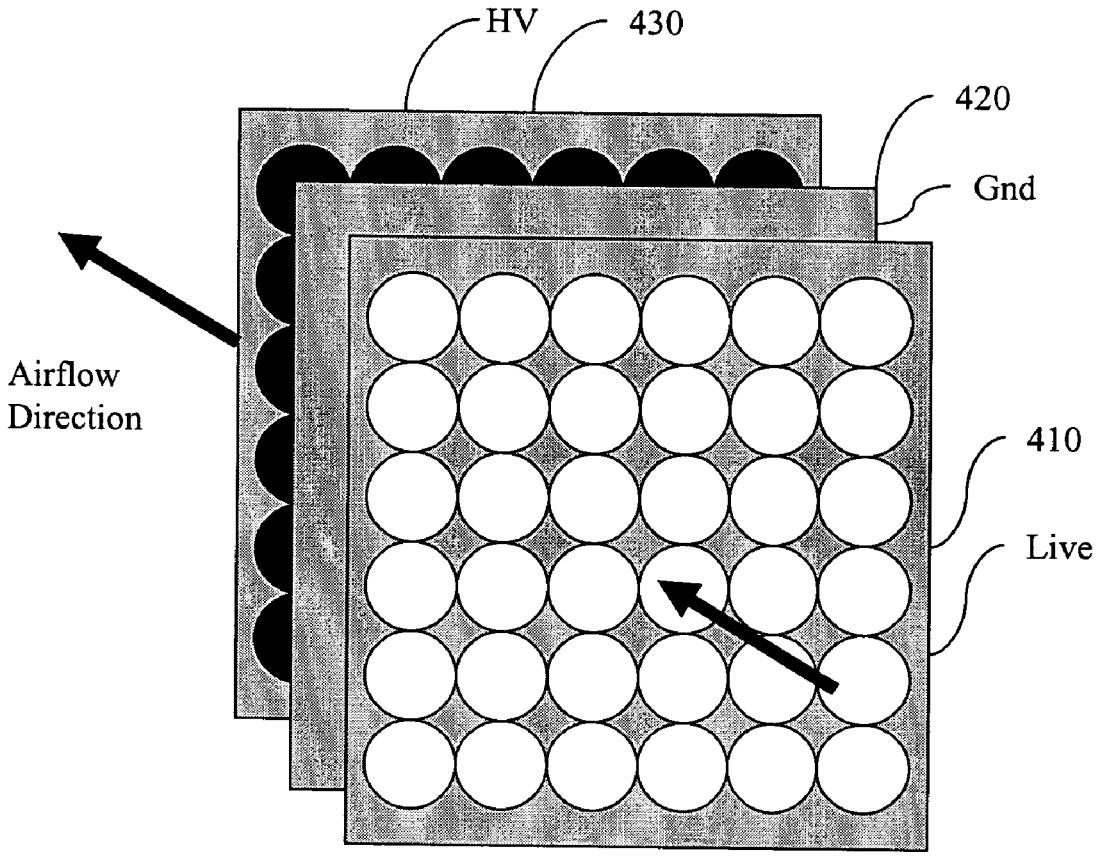
FIG. 4 illustrates another example arrangement of high voltage areas and low voltage areas in an airborne conductive contaminant handler.

FIG. 4 illustrates an example arrangement of high voltage areas and low voltage areas in an airborne conductive contaminant handling system. A first set of relatively high voltage contacts may be arranged, for example, in plane 410. A second set of relatively low voltage contacts may be arranged, for example, in plane 420. A third set of relatively higher voltage circuits (e.g., attracting circuits) may be arranged in plane 430. Thus, as air is presented to the handling system, it may be attracted by the attracting circuits in plane 430 towards the high voltage contacts 410 and the low voltage contacts 420. When a conductive contaminant spans the distance between a high voltage contact and a low voltage contact, a current may be discharged through the contaminant, leading to its destruction. For example, the conductive contaminant may be substantially instantaneously vaporized. While planes 410 and 430 are illustrated as high voltage contacts and plane 420 is a low voltage contact, it is to be appreciated that other arrangements are possible. For example, planes 410 and 430 could be ground contacts and plane 420 could be a high voltage contact. Furthermore, while FIG. 4 and other figures describe a zinc whisker coming in contact with two contacts, it is to be appreciated that a zinc whisker that is too short to span two contacts may be attracted to a high voltage contact and be contained there. Over time the zinc whisker may grow and then come in contact with the low voltage or ground contact and then be vaporized. Thus, it is to be appreciated that the example systems and methods described herein may contain a zinc whisker for a period of time and then destroy it at a later time.

Figure 5:
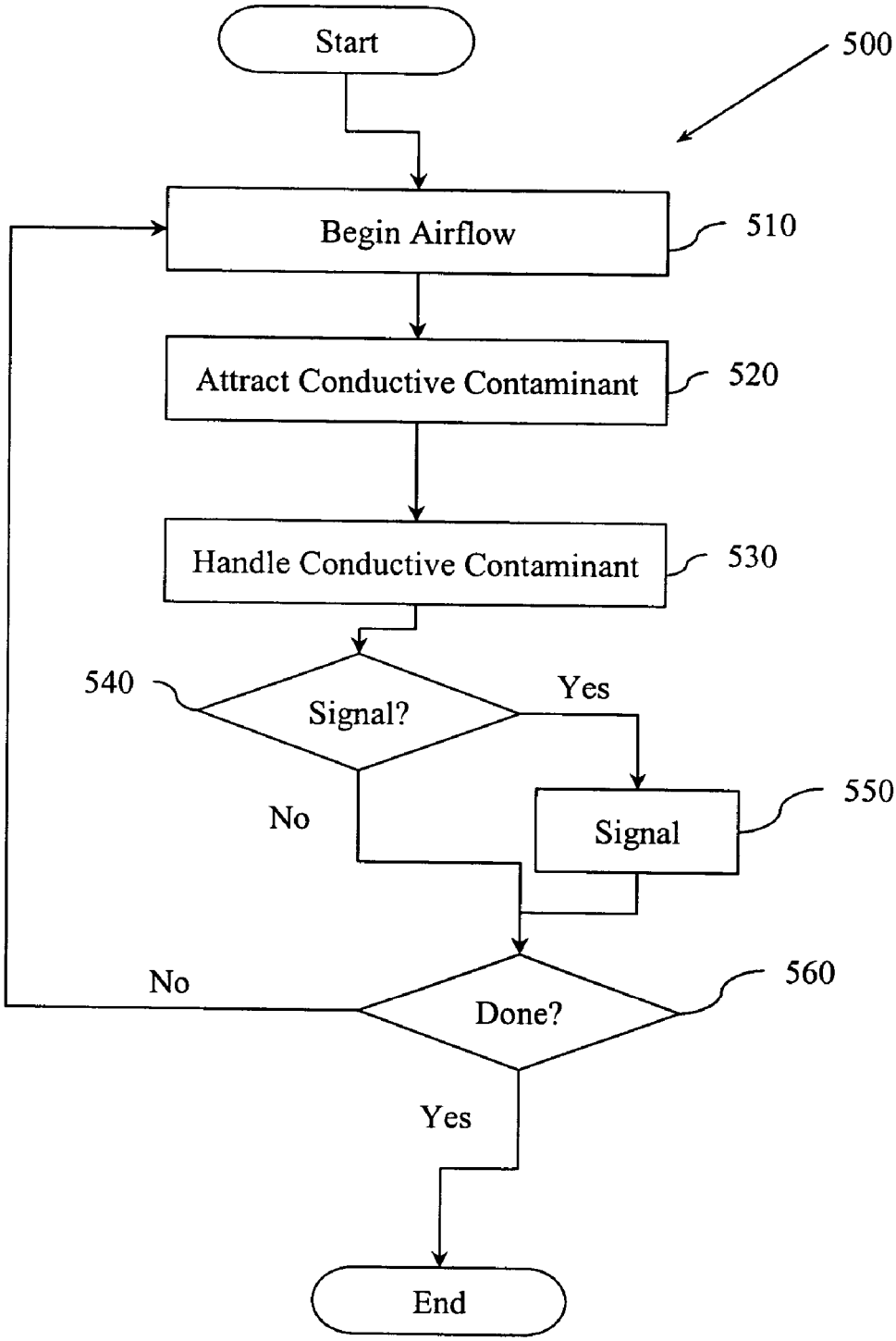
FIG. 5 illustrates an example method for handling airborne conductive contaminants.

Example methods may be better appreciated with reference to the flow diagram of FIG. 5. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Furthermore, additional and/or alternative methodologies can employ additional, not illustrated blocks. In one example, methodologies are implemented as processor executable instructions and/or operations stored on a computer-readable medium.

In the flow diagrams, blocks denote "processing blocks" that may be implemented, for example, in software. A flow diagram does not depict syntax for any particular programming language, methodology, or style (e.g., procedural, object-oriented). Rather, a flow diagram illustrates functional information one skilled in the art may employ to fabricate logic to perform the illustrated processing. It will be appreciated that in some examples, program elements like temporary variables, routine loops, and so on are not shown. It will be further appreciated that electronic and software applications may involve dynamic and flexible processes so that the illustrated blocks can be performed in other sequences that are different from those shown and/or that blocks may be combined or separated into multiple components. It will be appreciated that the processes may be implemented using various programming approaches like machine language, procedural, object oriented and/or artificial intelligence techniques.

FIG. 5 illustrates an example method 500 for handling airborne conductive contaminants. The method 500 may include, at 510, beginning and/or controlling an airflow through an apparatus that performs the method 500. For example, if the method 500 is not being executed at a certain point in time, then it may be beneficial to restrict air flow through the idle apparatus. Alternatively, in method 500, controlling airflow may be optional.

The method 500 may include, at 520, attracting an airborne conductive contaminant to a handling region. The contaminant may be attracted, for example, electro-magnetically. The handling region may be, for example, a region that includes one or more handling circuits. The electro-magnetic attraction may be generated by, for example, one or more attracting circuits.

The method 500 may also include, at 530, selectively applying an electric charge to the airborne conductive contaminant in the handling region. For example, if the airborne conductive contaminant closes a handling circuit, then in one example, a destructive current may be passed through the contaminant. In one example, at 530, handling the conductive contaminant may include discharging an electric charge sufficient to substantially destroy a zinc whisker with a direct current resistance of about five ohms to about fifty ohms. In another example, at 530, handling the conductive contaminant may include discharging an electric charge sufficient to substantially destroy a zinc whisker with a direct current fusing current of about 5 mA to about 40 mA.

In another example, a relatively lower current whose flow can be detected by a signaling logic may initially be passed through the conductive contaminant that closed the handling circuit. This relatively lower current may be employed, for example, to generate a signal associated with having detected and/or handled a conductive contaminant. Thus, the method 500 may also include, at 540, determining whether to generate a signal. The signal may indicate, for example, that an electric charge has been selectively applied to an airborne conductive contaminant and/or that an airborne conductive contaminant has been encountered. For example, if a circuit is closed and a current passes through the contaminant, a logic may note the current flow and determine whether to generate the signal. If the determination at 540 is Yes, then at 550 the signal may be generated. The signal may be employed to control, for example, other processes and/or apparatus associated with airborne conductive contaminant handling. For example, a warning light that indicates that airborne conductive contaminants like zinc whiskers have been encountered may be lit. Similarly, an email message may be generated and sent to systems administrators and engineers associated with the system that encountered the airborne conductive contaminant. In one example, the signal can selectively control one or more handling circuits configured to destroy airborne conductive contaminants. In another example, the signal can selectively control one or more air directing apparatus. For example, the signal may cause an air directing apparatus to selectively accelerate or decelerate airflow through a system based on the number and/or frequency of airborne conductive contaminants encountered. In one embodiment, a monitoring logic can be configured to monitor and store data associated with the handling circuit like the number and/or frequency of contaminants encountered.

While FIG. 5 illustrates various actions occurring in serial, it is to be appreciated that various actions illustrated in FIG. 5 could occur substantially in parallel. By way of illustration, a first process could control airflow, a second process could control attracting conductive contaminants, a third process could control handling (e.g., destroying, collecting) the airborne conductive contaminants and a fourth process could control signaling users, other processes and/or systems that airborne conductive contaminants have been detected and/or handled. While four processes are described, it is to be appreciated that a greater and/or lesser number of processes could be employed and that lightweight processes, regular processes, threads, and other approaches could be employed.

In one example, a computer-readable medium may store processor executable instructions operable to perform a method that includes electro-magnetically attracting an airborne conductive contaminant to a handling region and selectively applying an electric charge to the airborne conductive contaminant in the handling region. In another example, the method may also include selectively generating a signal that an electric charge has been selectively applied to an airborne conductive contaminant and/or selectively controlling handling circuits configured to destroy airborne conductive contaminants based on the signal. Additionally, the method may also include selectively controlling air directing apparatus based on the signal.

Figure 6:
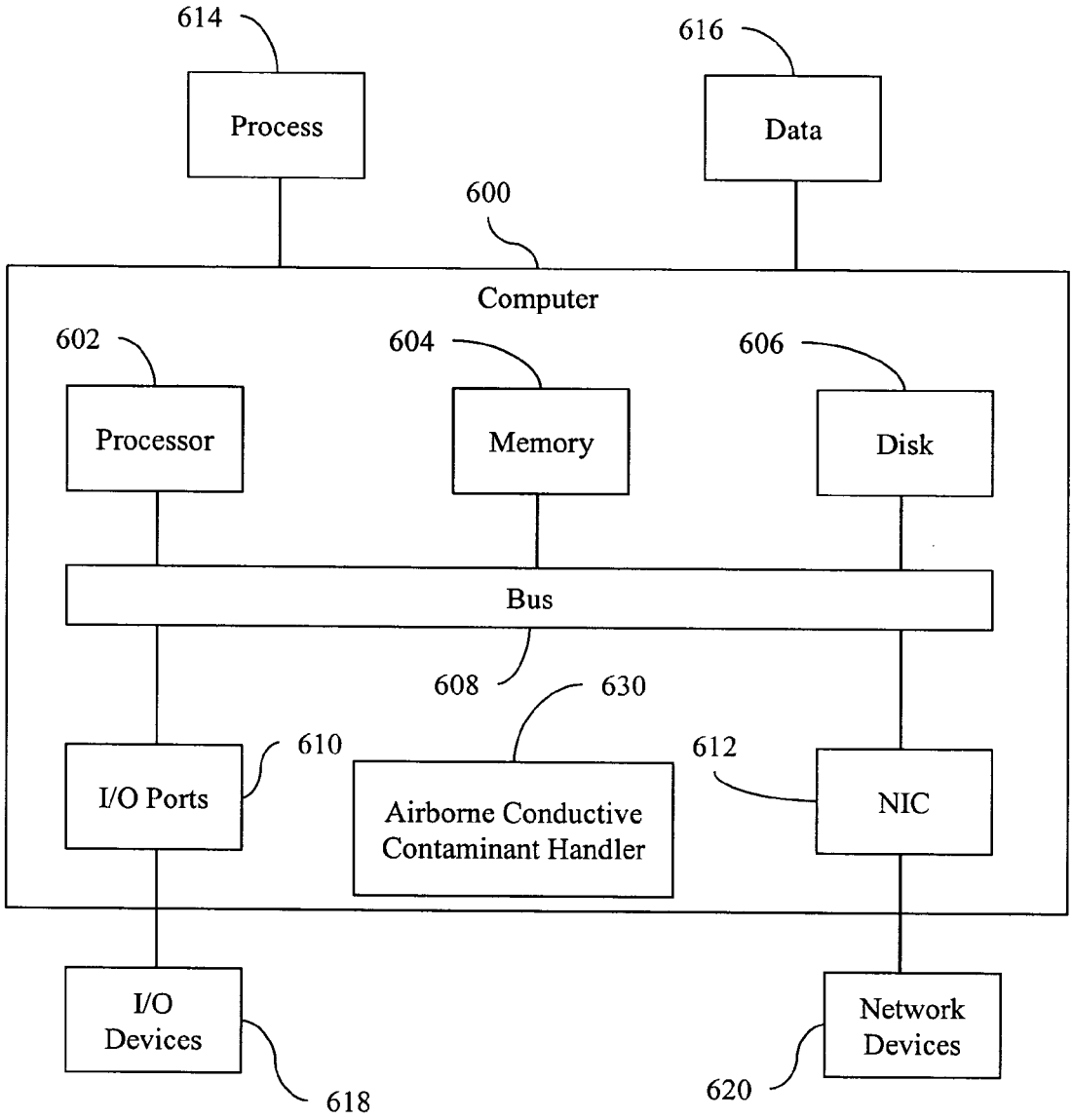
FIG. 6 illustrates an example computing system that may be protected by an airborne conductive contaminant handler.

FIG. 6 illustrates a computer 600 that includes a processor 602, a memory 604, a disk 606, input/output ports 610, and a network interface 612 operably connected by a bus 608. The air to which the processor 602, the memory 604, the disk 606, the input/output ports 610, the network interface 612 and the bus 608 are exposed may be processed, for example, by an airborne conductive contaminant handler 630. In one example, the air may be pre-conditioned, while in other examples the air may be post-conditioned and/or conditioned substantially in parallel with being provided to the components. While the airborne conductive contaminant handler 630 is illustrated inside the computer 600, it is to be appreciated that the airborne conductive contaminant handler 630 could be located completely within the computer 600, partially within the computer 600, external to but connected to the computer 600, and separate from the computer 600. When located external to the computer 600, the airborne conductive contaminant handler 630 may be positioned so that air being employed by the computer 600 passes near and/or through the airborne conductive contaminant handler 630.

In one example, the airborne conductive contaminant handler 630 can be configured to selectively generate a signal that an airborne conductive contaminant has been handled. In another example, the airborne conductive contaminant handler 630 may be configured to substantially immediately destroy airborne conductive contaminants like zinc whiskers. In another example, the airborne conductive contaminant handler 630 may be configured to collect airborne conductive contaminants like zinc whiskers for a period of time before the contaminants are collected and/or destroyed. By way of illustration, consider a bug zapper on a porch on a summer evening. Bugs are attracted to the electric blue light. In a first bug zapper, the bugs may be allowed to come in contact with wires exposed near the blue light, where the contact dispatches the bugs. However, in a second bug zapper, bugs may be allowed to come close to the electric blue light and when a bug presence is detected the portals through which the bug(s) was allowed to pass may close allowing the capture of the bug(s). The bug(s) may then be selectively disposed of (e.g., released to the wild, studied, destroyed) at a later time. In a third bug zapper, after a certain number of bugs have drawn near to the electric blue light, a shield that is keeping the bugs from the exposed wires may be lowered and/or the exposed wires may be powered and the bugs may meet their demise collectively. In this way, the number of discharges from the bug zapper may be reduced and/or the time at which electrical discharges are made can be controlled.

Similarly, a first airborne conductive contaminant handler, a "zinc whisker zapper", may be configured to substantially immediately destroy zinc whiskers that it encounters. However, a second airborne conductive contaminant handler may be configured to attract and capture airborne conductive contaminants to facilitate, for example, studying the contaminants (e.g., determining size, origin, materials) or to facilitate destroying multiple contaminants with one discharge of the system.

The processor 602 can be a variety of various processors including dual microprocessor and other multi-processor architectures. The memory 604 can include volatile memory and/or non-volatile memory. The non-volatile memory can include, but is not limited to, read only memory (ROM), programmable read only memory (PROM), electrically programmable read only memory (EPROM), electrically erasable programmable read only memory (EEPROM), and the like. Volatile memory can include, for example, random access memory (RAM), synchronous RAM (SRAM), dynamic RAM (DRAM), synchronous DRAM (SDRAM), double data rate SDRAM (DDR SDRAM), and direct RAM bus RAM (DRRAM). The disk 606 can include, but is not limited to, devices like a magnetic disk drive, a floppy disk drive, a tape drive, a Zip drive, a flash memory card, and/or a memory stick. Furthermore, the disk 606 can include optical drives like a compact disc ROM (CD-ROM), a CD recordable drive (CD-R drive), a CD rewriteable drive (CD-RW drive), and/or a digital versatile ROM drive (DVD ROM). The memory 604 can store processes 614 and/or data 616, for example. The disk 606 and/or memory 604 can store an operating system that controls and allocates resources of the computer 600.

The bus 608 can be a single internal bus interconnect architecture and/or other bus architectures. The bus 608 can be of a variety of types including, but not limited to, a memory bus or memory controller, a peripheral bus or external bus, and/or a local bus. The local bus can be of varieties including, but not limited to, an industrial standard architecture (ISA) bus, a microchannel architecture (MSA) bus, an extended ISA (EISA) bus, a peripheral component interconnect (PCI) bus, a universal serial (USB) bus, and a small computer systems interface (SCSI) bus.

The computer 600 interacts with the input/output devices 618 via the input/output ports 610. The input/output devices 618 can include, but are not limited to, a keyboard, a microphone, a pointing and selection device, cameras, video cards, displays, and the like. The input/output ports 610 can include but are not limited to, serial ports, parallel ports, and USB ports.

The computer 600 can operate in a network environment and thus is connected to the network devices 620 by the network interface (NIC) 612. Through the network devices 620, the computer 600 may interact with a network. Through the network, the computer 600 may be logically connected to remote computers. The networks with which the computer 600 may interact include, but are not limited to, a local area network (LAN), a wide area network (WAN), and other networks. The network interface 612 can connect to LAN technologies including, but not limited to, fiber distributed data interface (FDDI), copper distributed data interface (CDDI), Ethernet/IEEE 802.3, token ring/IEEE 802.5, wireless/IEEE 802.11, Bluetooth, and the like. Similarly, the network interface 612 can connect to WAN technologies including, but not limited to, point to point links, circuit switching networks like integrated services digital networks (ISDN), packet switching networks, and digital subscriber lines (DSL).

Figure 7:
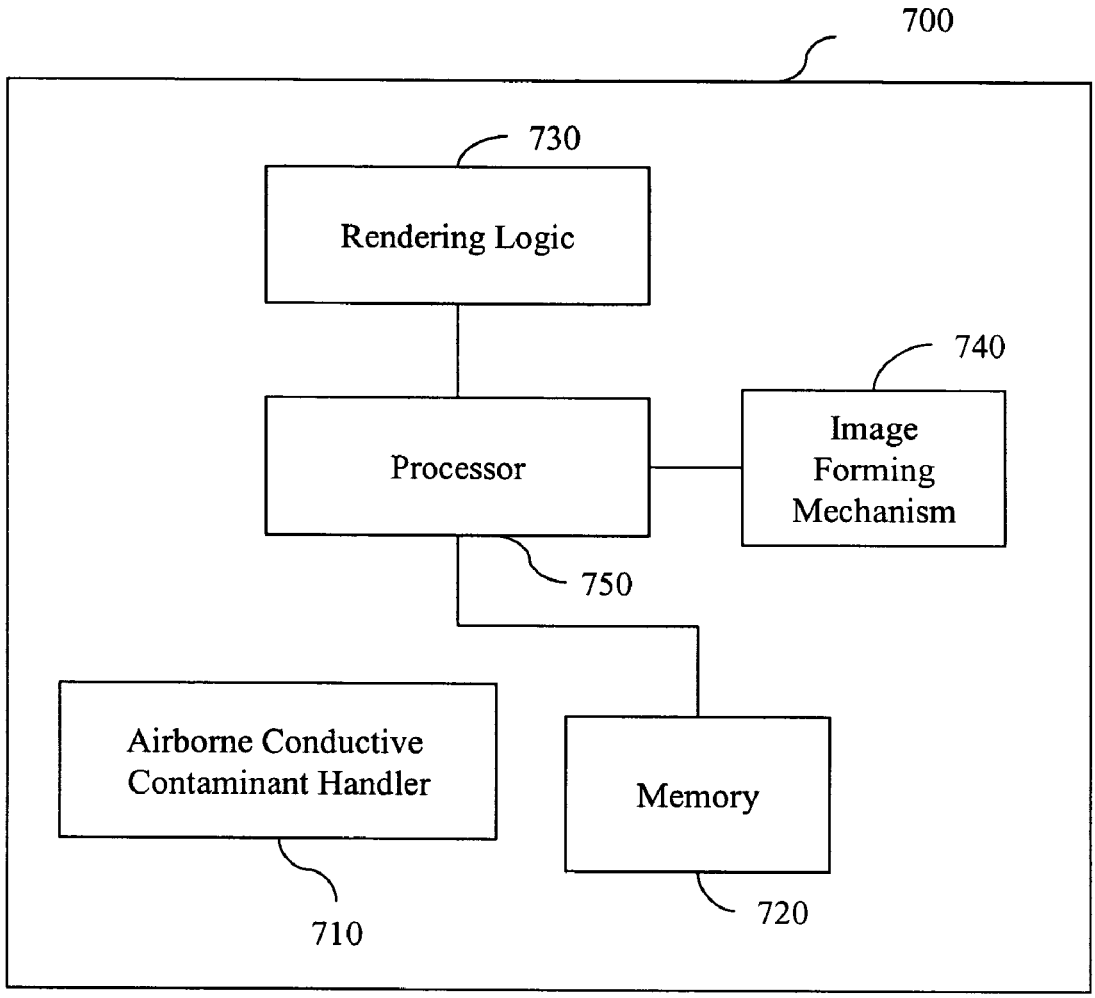
FIG. 7 illustrates an example image forming device that may be protected by an airborne conductive contaminant handler.

FIG. 7 illustrates an example image forming device 700 that includes an airborne conductive contaminant handler 710. In one example, the airborne conductive contaminant handler 710 can be configured to attract, capture, and/or destroy airborne contaminants like zinc whiskers. In another example, the airborne conductive contaminant handler 710 can be configured to selectively generate a signal that an airborne conductive contaminant has been handled. In one example, the airborne conductive contaminant handler 710 is located completely inside the image forming device 700, while in other examples the airborne conductive contaminant handler 710 is located partly inside and partly outside the image forming device 700, completely outside but attached to the image forming device 700 and external to and not attached to the image forming device 700.

The image forming device 700 may include a memory 720 configured to store print data, for example, or to be used more generally for image processing. The image forming device 700 may receive print data to be rendered. Thus, the image forming device 700 may include a rendering logic 730 configured to generate a printer-ready image from print data. Rendering varies based on the format of the data involved and the type of imaging device. In general, the rendering logic 730 converts high-level data into a graphical image for display or printing (e.g., the print-ready image). For example, one form is ray-tracing that takes a mathematical model of a three-dimensional object or scene and converts it into a bitmap image. Another example is the process of converting HTML into an image for display/printing. It is to be appreciated that the image forming device 700 may receive printer-ready data that does not need to be rendered and thus the rendering logic 730 may not appear in some image forming devices.

The image forming device 700 may also include an image forming mechanism 740 configured to generate an image onto print media from the print-ready image. The image forming mechanism 740 may vary based on the type of the imaging device 700 and may include a laser imaging mechanism, other toner-based imaging mechanisms, an ink jet mechanism, digital imaging mechanism, or other imaging reproduction engine.

The image forming device may also include a processor 750. In one example, the processor 750 includes logic that is capable of executing Java instructions. Other components of the image forming device 700 are not described herein but may include media handling and storage mechanisms, sensors, controllers, and other components involved in the imaging process.

Figure 8:
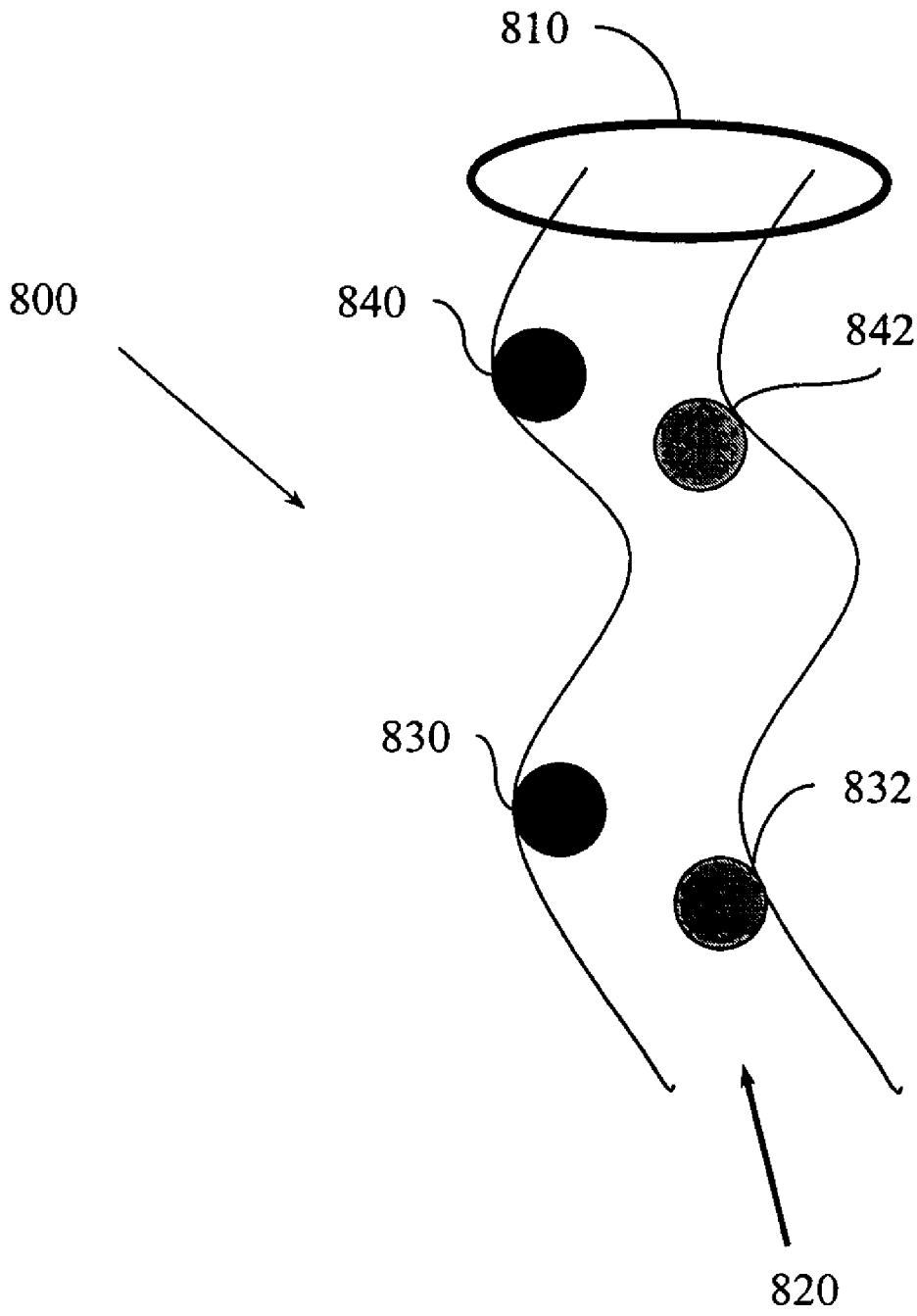
FIG. 8 illustrates a portion of an example single channel airborne conductive contaminant handler.

FIG. 8 illustrates a portion 800 of an example single channel airborne conductive contaminant handler. The illustrated portion 800 includes an attracting circuit 810 that facilitates moving airborne conductive contaminants from the mouth 820 of the single channel airborne conductive contaminant handler towards a handling circuit(s). Portion 800 includes two sets of contacts. A first set includes a relatively higher voltage contact 830 and a relatively lower voltage contact 832. The contacts 830 and 832 may be portions of a direct current circuit or an alternating current circuit. By way of illustration, in an alternating current circuit, the contact 830 may be the source or "hot" contact and the contact 832 may be the neutral or "ground" contact. By way of further illustration, in a direct current circuit, the contact 830 may be the positive contact (e.g., +50V) and the contact 832 may be the negative contact (e.g., −50V). If an airborne conductive contaminant is drawn into the mouth 820 of the single channel airborne conductive contaminant handler and then comes in contact with both contact 830 and contact 832 at the same time, then current may flow through the contaminant, which may cause it to be destroyed.

Portion 800 also includes a second set of contacts 840 and 842. If the contaminant closes a circuit that includes contacts 840 and 842, then once again current may flow through the contaminant causing its destruction. Additionally, and/or alternatively, if a contaminant falls across contacts 830 and 842 or across contacts 840 and 832, a circuit may also be closed and the current may flow. Thus, although two sets of contacts are displayed, the two sets of contacts may be associated with more than two possible handling circuits. Furthermore, while the contacts 830, 832, 840, and 842 are illustrated in an alternating pattern, it is to be appreciated that contacts may be located in various other arrangements. Further still, while the attracting circuit 810 is illustrated separate from the contacts 830, 832, 840, and 842, it is to be appreciated that the attracting circuit 810 and the contacts 830, 832, 840, and 842 can be part of one circuit.

Figure 9:
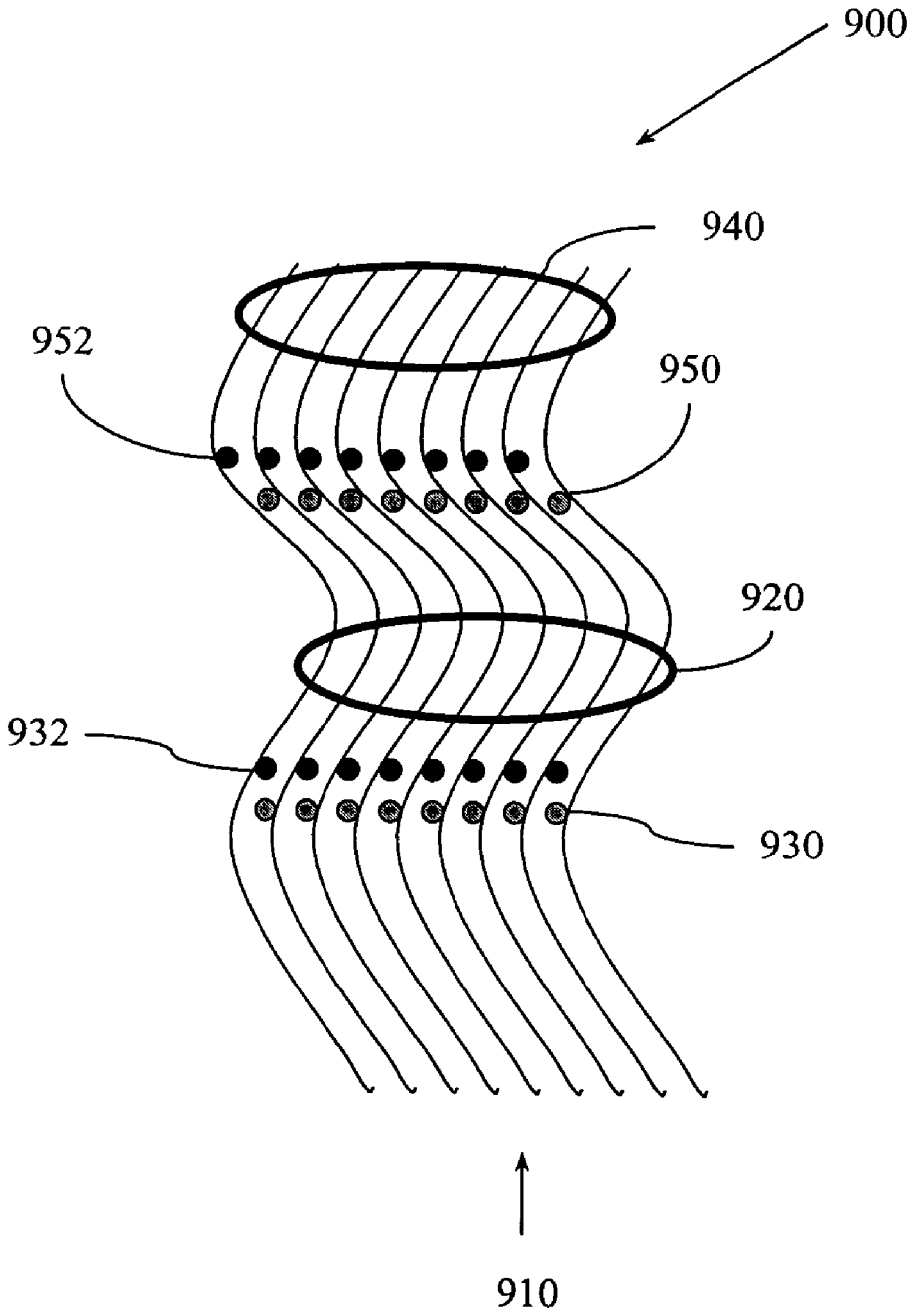
FIG. 9 illustrates a portion of an example multiple channel airborne conductive contaminant handler.

FIG. 9 illustrates a portion 900 of an example multiple channel airborne conductive contaminant handler. Airborne conductive contaminants may enter the portion 900 through region 910 and be attracted by an attracting circuit 920 up one of a plurality of air channels towards sets of contacts 930 and 932. Since some airborne conductive contaminants may pass through the first sets of contacts 930 and 932, the portion 900 may also include a second attracting circuit 940 that draws conductive contaminants up the plurality of air channels towards sets of contacts 950 and 952. Once again, various arrangements of contacts and attracting circuits can be employed.

Figure 10:
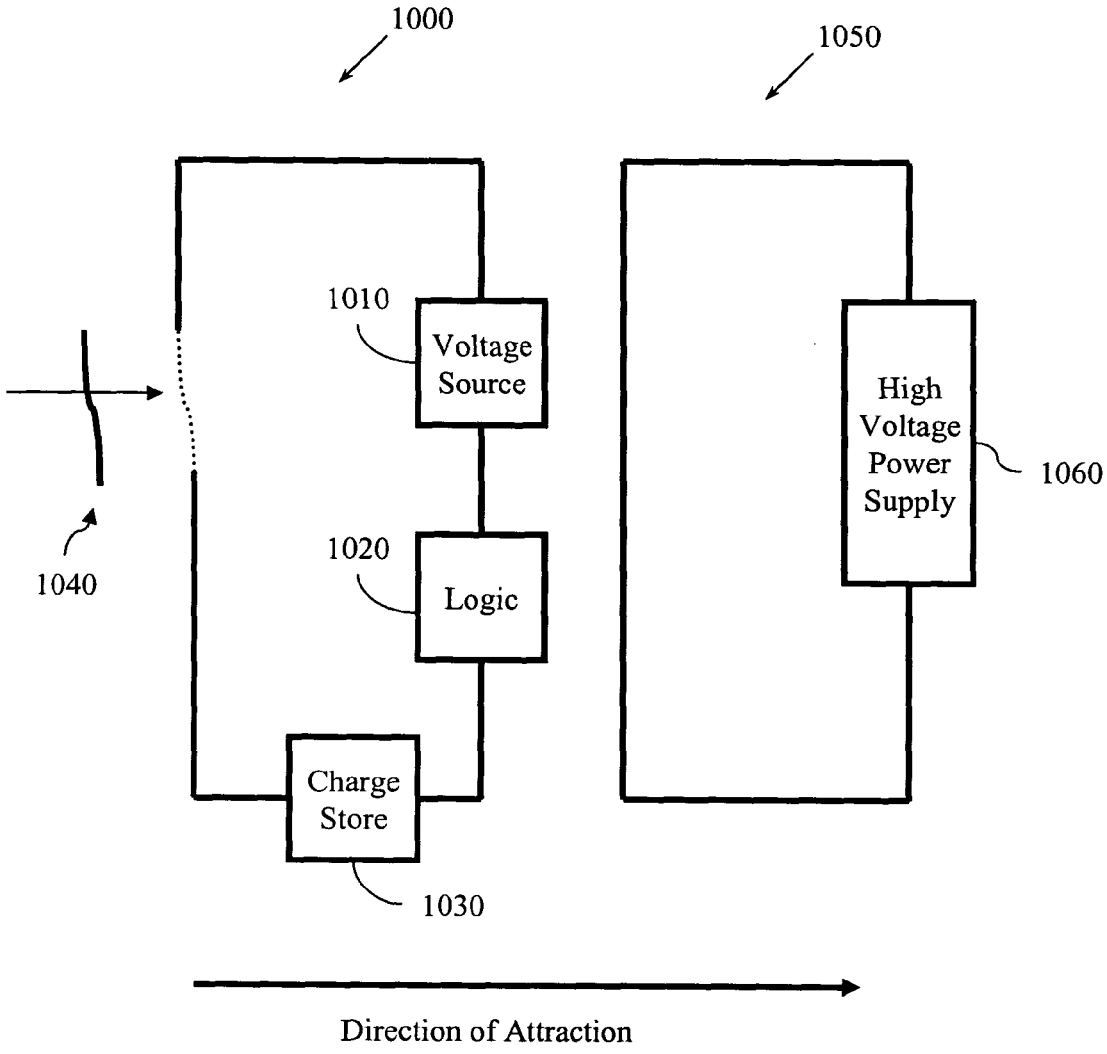
FIG. 10 is a block diagram of an example handling circuit and an example attracting circuit.

FIG. 10 is a block diagram of an example handling circuit 1000 and an example attracting circuit 1050. In one example, the handling circuit 1000 includes a voltage source 1010 that may supply voltage to the circuit 1000. The circuit 1000 may also include a logic 1020 that can determine and/or control the amount of current that will flow through the circuit 1000. For example, when an airborne contaminant 1040 first closes the circuit 1000, the logic 1020 may allow a first amount of current to flow through the circuit 1000. Then, after the first amount of current has flown through the circuit 1000, and/or after a signal has been generated concerning the presence of the circuit closing contaminant 1040, the logic 1020 may direct that a second amount of current should flow through the circuit 1000. The first amount of current may be employed, for example, to measure the resistance of the contaminant 1040 and/or other properties. Once the analysis has been performed, the logic 1020 may, for example, control the amount of current that is passed through the contaminant 1040 to facilitate efficiently destroying the contaminant 1040. The circuit 1000 may also include a charge store 1030 (e.g., capacitor) that facilitates a rapid electric discharge across, for example, the airborne contaminant 1040 that closes the circuit.

The attracting circuit 1050 may include, for example, a high voltage power supply 1060 that is configured to produce a high voltage in the attracting circuit 1050. By way of illustration, a first high voltage power supply 1060 may provide more than 220 volts while a second high voltage power supply 1060 may provide more than 110 volts and a third high voltage power supply 1060 may provides more than 5 volts. It is to be appreciated that the high voltage power supply 1060 may be a variable power supply that can be dynamically reconfigured to supply various voltages based, for example, on the type of components that the airborne conductive contaminant system is to protect. Thus, the attracting circuit 1050 can be configured to protect different types of components by having the high voltage power supply 1060 supply a voltage that is greater than the voltage provided to a component to be protected from airborne conductive contaminants. While the handling circuit 1000 and the attracting circuit 1050 are illustrated as independent circuits, it is to be appreciated that the attracting and handling functions can be performed by one, two, or a larger number of circuits, components, and so on.

Figure 11:
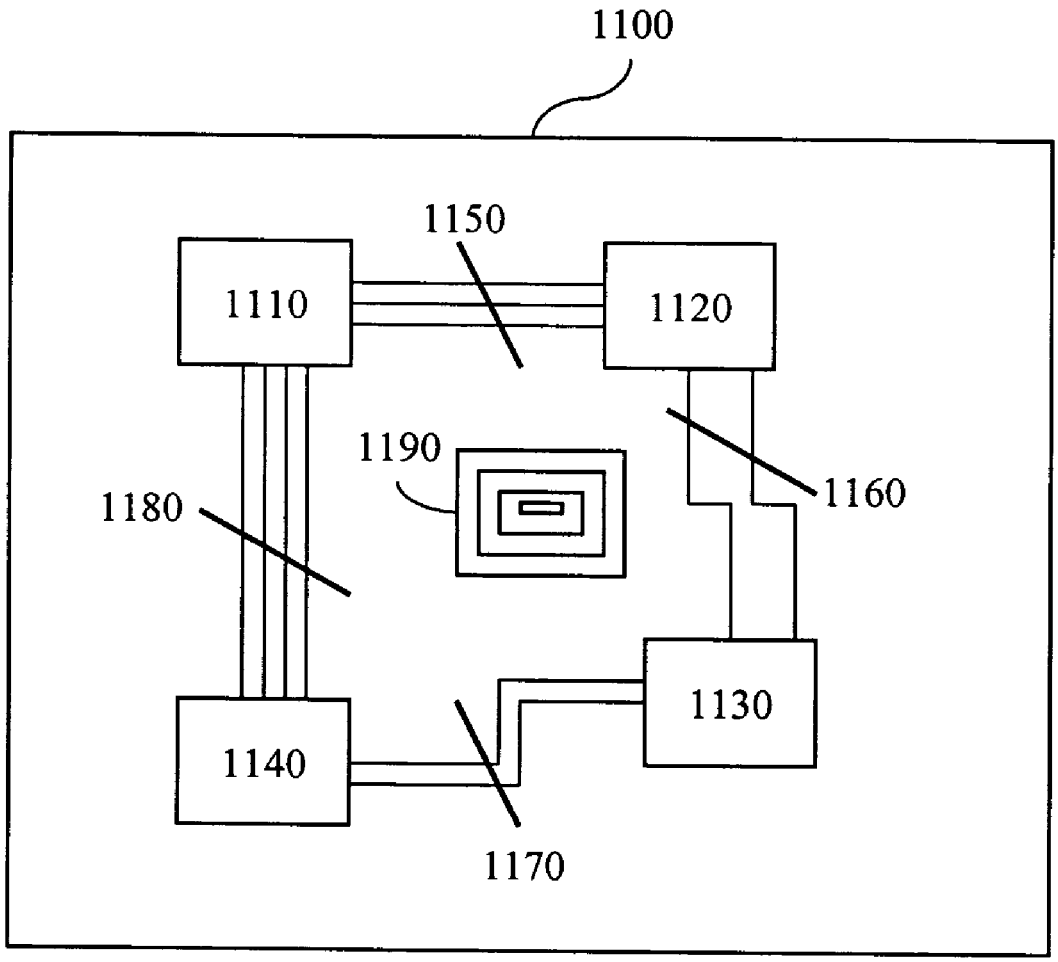
FIG. 11 illustrates an example computer circuit board that includes an airborne conductive contaminant handler.

FIG. 11 illustrates an example computer circuit board 1100. The example computer circuit board 1100 may include, for example, integrated circuits 1110, 1120, 1130, and 1140 that are connected by runs 1150, 1160, 1170, and 1180. If an airborne conductive contaminant came to rest across a voltage potential in one or more of the runs, then the circuit board 1100 and/or one of the integrated circuits 1110, 1120, 1130, and 1140 may exhibit an undesired behavior. Thus, in one example, the computer circuit board 1100 may include an airborne conductive contaminant handler 1190. The handler 1190 can be configured to attract and electrically reduce airborne conductive contaminants that may approach the circuit board 1100 thereby reducing the likelihood that an airborne conductive contaminant may come to rest across a voltage potential on the circuit board 1100. In one example, the handler 1190 may be configured as a replaceable part on the computer circuit board 1100. While one handler 1190 is illustrated, it is to be appreciated that a computer circuit board 1100 could be protected by one or more handlers 1190. Furthermore, while a computer circuit board 1100 is illustrated, it is to be appreciated that other electric and/or electronic sub-assemblies could be similarly protected.

While the example systems have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the example systems employed in detecting and processing airborne conductive contaminants like zinc whiskers in computers, electric and/or electronic components. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicants' general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "having" is employed in the detailed description or the claims, it is intended to be inclusive in a manner similar to the term "comprising" as that term is interpreted when employed as a transitional word in a claim. Furthermore, to the extent that the term "or" is employed in the claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Gamer, A Dictionary of Modern Legal Usage 624 (2d. Ed. 1995).

What is claimed is:

1. An airborne conductive contaminant handling system, comprising:

a handling circuit configured to selectively pass an electric current through a conductive contaminant; and an attracting circuit configured to attract an airborne conductive contaminant towards the handling circuit.

2. The system of claim 1, where the handling circuit includes a first contact and a second contact, and where the handling circuit is configured to selectively pass the electric current through the conductive contaminant when the conductive contaminant is in contact with both the first contact and the second contact.

3. The system of claim 2, where the handling circuit includes a control logic configured to control when the handling circuit will selectively pass the electric current through the conductive contaminant.

4. The system of claim 2, where the handling circuit includes a control logic configured to generate a signal indicating that a conductive contaminant is in contact with both the first contact and the second contact.

5. The system of claim 1, where the attracting circuit includes a high voltage power supply configured to produce a high voltage in the attracting circuit.

6. The system of claim 5, where the high voltage power supply provides more than 220 volts.

7. The system of claim 5, where the high voltage power supply supplies a voltage that is greater than the voltage provided to a component to be protected from airborne conductive contaminants.

8. The system of claim 7, where the component to be protected is a power supply.

9. The system of claim 7, where the component to be protected is an integrated circuit.

10. The system of claim 1, where the handling circuit and the attracting circuit comprise a single electric circuit.

11. The system of claim 1, where the attracting circuit electro-magnetically attracts the airborne conductive contaminant towards the handling circuit.

12. The system of claim 1, where the airborne conductive contaminant is a zinc whisker.

13. The system of claim 12, where the electric current is sufficient to substantially destroy a zinc whisker having a direct current resistance of about five ohms to about fifty ohms.

14. The system of claim 12, where the electric current is sufficient to substantially destroy a zinc whisker with a direct current fusing current of about 5 mA to about 40 mA.

15. The system of claim 1, comprising:

means for receiving air from an external environment that may contain airborne conductive contaminants and directing the air towards the attracting circuit.

16. The system of claim 1, comprising:

means for selectively directing air from which an airborne conductive contaminant has been processed by the handling circuit relative to a component to be protected from airborne conductive contaminants.

17. The system of claim 1, where the airborne conductive contaminant handling system is physically located entirely within a computer.

18. The system of claim 1, where the airborne conductive contaminant handling system is physically located partly within a computer.

19. The system of claim 1, where the airborne conductive contaminant handling system is physically attached to the outside of a computer.

20. The system of claim 1, where the airborne conductive contaminant handling system is physically located entirely within an image forming device.

21. The system of claim 1, where the airborne conductive contaminant handling system is physically located partly within an image forming device.

22. The system of claim 1, where the airborne conductive contaminant handling system is physically attached to the outside of an image forming device.

23. The system of claim 2, where the first contact and the second contact are located not more than 500 microns apart.

24. The system of claim 2, where the first contact and the second contact are located not more than 20 microns apart.

25. The system of claim 1, where the handling circuit and the attracting circuit are arranged in a single air channel.

26. The system of claim 1, where one or more handling circuits and one or more attracting circuits are arranged in two or more air channels.

27. The system of claim 2, where the first contact is a first exposed wire and the second contact is a second exposed wire.

28. The system of claim 2, where the first contact and the second contact are located on a printed circuit board.

29. The system of claim 1, the system being configured as a replaceable component in one or more of a computer, a computer circuit board, an image forming device, and a power supply.

30. A method performable in the airborne conductive contaminant handling system of claim 1, comprising:

attracting an airborne conductive contaminant to a handling region; and applying an electric charge to the airborne conductive contaminant in the handling region.

31. The method of claim 30, where the airborne conductive contaminant is electro-magnetically attracted to the handling region.

32. The method of claim 31, where the electric charge is sufficient to substantially destroy a zinc whisker with a direct current resistance of about five ohms to about fifty ohms.

33. The method of claim 31, where the electric charge is sufficient to substantially destroy a zinc whisker with a direct current fusing current of about 5 mA to about 40 mA.

34. The method of claim 31, comprising:

selectively generating a signal that an electric charge has been applied to an airborne conductive contaminant.

35. The method of claim 31, comprising:

selectively controlling one or more handling circuits configured to destroy airborne conductive contaminants based, at least in part on the signal.

36. The method of claim 31, comprising:

selectively controlling one or more air directing apparatus based, at least in part, on the signal.

37. The method of claim 31, where the electric charge is selectively applied to the conductive contaminant.

38. The system of claim 1 where the handling circuit comprises:

means for detecting that the conductive contaminant has been attracted to the handling circuit; and means for destroying the conductive contaminant.

39. The system of claim 1 where the attracting circuit includes:

means for attracting one or more conductive contaminants to a desired location in the airborne conductive contaminant handling system.

* * * * *

UNITED STATES PATENT AND TRADEMARK OFFICE

CERTIFICATE OF CORRECTION

PATENT NO. : 6,989,049 B2
APPLICATION NO. : 10/655384
DATED : January 24, 2006
INVENTOR(S) : Steve Arthur Belson et al.

It is certified that error appears in the above-identified patent and that said Letters Patent is hereby corrected as shown below:

On the title page, item (75), in "Inventors", in column 1, line 1, delete "Stev Arthur Belson" and insert -- Steve Arthur Belson --, therefor.

Signed and Sealed this

Sixteenth Day of June, 2009

JOHN DOLL
*Acting Director of the United States Patent and Trademark Office*